US005394949A

United States Patent [19]

Wright et al.

[11] Patent Number: 5,394,949

[45] Date of Patent: Mar. 7, 1995

[54] MOBILE SOIL SAMPLING DEVICE

[76] Inventors: Nathan A. Wright, 122 Erie St., Oak Harbor, Ohio 43449; Herbert L. Wright, 2720 C.R. 254, Vickery, Ohio 43464

[21] Appl. No.: 261,419

[22] Filed: Jun. 17, 1994

[51] Int. Cl.[6] ..... E21B 3/02

[52] U.S. Cl. ..... 175/20; 175/121; 175/162; 175/170; 175/203

[58] Field of Search ..... 175/20, 58, 203, 308, 175/49, 162; 73/864.43

[56] References Cited

U.S. PATENT DOCUMENTS

| | | | |
|---|---|---|---|
| 2,239,024 | 4/1941 | Vance | 175/162 |
| 2,810,550 | 10/1957 | Cohen et al. | 175/162 |
| 2,856,156 | 10/1958 | Young | 175/203 |
| 3,464,504 | 9/1969 | Stange . | |
| 3,502,543 | 3/1970 | Sewell | 175/162 |
| 3,593,809 | 7/1971 | Derry . | |
| 4,284,150 | 8/1981 | Davis . | |
| 4,332,301 | 6/1982 | Jonell | 175/58 X |
| 4,333,541 | 6/1982 | Doty . | |
| 4,482,021 | 11/1984 | Repski . | |
| 4,534,231 | 8/1985 | Jonsson et al. . | |
| 4,685,339 | 8/1987 | Philipenko . | |
| 4,828,047 | 5/1989 | Rogerson . | |
| 4,998,590 | 3/1991 | Wells | 175/203 X |
| 5,033,554 | 7/1991 | Younes | 175/162 X |
| 5,076,372 | 12/1991 | Hellbusch . | |
| 5,213,169 | 5/1993 | Heller | 175/162 X |

*Primary Examiner*—Ramon S. Britts
*Assistant Examiner*—Frank S. Tsay
*Attorney, Agent, or Firm*—Marshall & Melhorn

[57] ABSTRACT

A vehicle mounted mechanized soil sample collecting unit including a sampler arm pivotably affixed to a base mounted upon the vehicle. At its remote end the sampler arm pivotably carries a soil auger and soil accumulator container. An actuator is coupled to the sampler arm for swinging the arm between a lowered, soil-collecting position and a retracted container discharge position. A power unit rotates the soil auger, which is adapted to advance through the bottom of the container and into the earth as the container engages the surface of the earth upon lowering of the sampler arm. As the auger rotates the soil sample is drawn upwardly into the accumulator container by the auger flights. With the sampler arm in the retracted position the accumulator container is positioned over a funnel device into which collected soil is deposited through a bottom trap door of the accumulator container for reception in a sample container beneath the funnel outlet.

11 Claims, 3 Drawing Sheets

MOBILE SOIL SAMPLING DEVICE

BACKGROUND OF THE INVENTION

1. Field of the Invention

The present invention pertains broadly to a device for collecting soil samples, and more particularly to such a device which is mechanized and mounted upon a vehicle for enabling a single operator to rapidly and accurately collect a series of individual test samples and place the collected samples in receptacles for subsequent analysis.

2. Description of the Prior Art

In the field of agricultural production, farmers are constantly challenged in an ever changing economy to seek ways to increase efficiency and profitability of production. One routine commonly employed to that end is the carrying out of a soil testing program to determine the proper rates of application of fertilizers and herbicides. In order to achieve more accurate fertilizer application, and thus better utilization, it is highly desirable to assess the soil fertility throughout a field. This requires intensive soil sampling, for example on a field grid basis, involving collection of many soil samples for separate laboratory analysis.

As will be readily apparent the success of such a program depends upon the proper and inexpensive collection of soil samples. The samples must consistently represent the true soil conditions of an area to be treated. For example, the samples must represent the true available nutrient status of an area to be fertilized, or other appropriate parameters for areas to be treated with herbicides, insecticides and the like. The majority of technological advances in this field has been in the development of nutrient and herbicide application equipment, and the technique of soil sampling has not kept pace. Many suppliers currently using computer-controlled fertilizer and herbicide applicators still collect soil samples by means of a hand operated hollow tube probe, with no depth indication. Consequently, the soil sampling is highly subjective and operator dependent. The benefits of sophisticated computer-controlled fertilizer and herbicide application cannot be fully utilized unless the precision and accuracy of soil sampling is improved.

As heretofore indicated soil sampling has in the past, and still largely is, done by manually inserting a hollow tube probe into the ground a certain distance, and then withdrawing the probe containing collected soil. The collected soil is then removed from the probe for subsequent analysis. As can be readily appreciated, this is a laborious and time consuming task not conducive to intensive soil sampling. Furthermore, due to resistance to penetration under certain soil conditions and obstructions such as rocks beneath the surface, the samples tend to be taken at different depths so as to produce inconsistent test results.

Various types of mechanical soil samplers have been proposed, a number of them incorporating hollow tube probes into mechanism supplying weight and power for causing the probe to penetrate hard soils. Examples of such devices are disclosed in U.S. Pat. Nos. 3,464,504, 4,284,150, 4,333,541, 4,685,339, and 4,828,047. Other mechanical samplers employ a rotatably driven auger shaft which bores into the soil and withdraws a sample into a receptacle. Such devices are disclosed, for example in U.S. Pat. Nos. 3,593,809, 4,482,021, 4,534,231 and 5,076,372.

These devices are of substantial size and complexity and are generally designed-to be operatively mounted upon a large vehicle such as a tractor or a heavy duty pickup truck. While the devices may eliminate the back breaking work of manual probing, each involves either the time consuming step of the operator frequently dismounting the vehicle for sample collection, or the services of two workers, one operating the vehicle and the other operating the soil collection device, to achieve greater speed in sample collecting. The rate of sample collection and efficient use of labor were apparently not of particular significance in the design of the devices. In addition, the prior art vehicle-mounted samplers are limited to use under weather and soil conditions which permit operation of the carrier vehicle, that is, the tractor or pickup truck in the field. The prior art devices thus do not entirely satisfy the requirements of present day agricultural practices for a soil sampling device which will make possible accurate and rapid collection of soil samples efficiently and inexpensively.

SUMMARY OF THE INVENTION

In accordance with the present invention there is provided a mechanized soil sampler which is easy to use, capable of rapidly collecting samples, labor efficient, relatively inexpensive, and allows for use under a wide variety of field conditions. The soil sampling unit is mounted upon a suitable mobile unit, preferably a four wheel all-terrain vehicle (ATV) or the like, whereby an operator can operate the sampling unit from the seat of the mobile unit without dismounting. The sampling unit includes a sampler arm pivotably affixed at one end to a base mounted upon the mobile unit. At its remote end the sampler arm pivotably carries a soil auger and soil accumulator container. An actuator is coupled to the sampler arm for swinging the arm between a lowered soil collecting position and a retracted accumulator container discharge position.

A power unit is provided for rotating the soil auger, and the auger is adapted to be extended through the bottom of the accumulator container and into the earth as the container engages the ground surface upon lowering of the sampler arm. As the auger rotates the soil sample is drawn upwardly into the accumulator container by the auger flights. Spring loaded depth control spacers operate in conjunction with the accumulator container to limit the depth to which the auger penetrates the soil to a predetermined distance. With the sampler arm in the retracted position the soil accumulator container is positioned over a funnel device mounted on and positioned above the base. The floor of the accumulator container comprises a hinged trap door which is readily manipulatable by the seated operator for discharging the collected soil sample into the funnel. A suitable receptacle such as a box or bag is positioned beneath the funnel for receiving one or more of the collected soil samples from the accumulator container. A holder may be provided on the base for storing empty receptacles awaiting use and receptacles containing collected samples. A separate power unit may be mounted upon the mobile unit for operating the sampler arm and the soil auger. Alternatively, the sampler arm and auger unit may suitably be powered by the engine of the mobile unit.

BRIEF DESCRIPTION OF THE DRAWINGS

In the drawings, wherein like numerals refer to like part throughout.

DESCRIPTION OF THE PREFERRED EMBODIMENT

Figure 1:
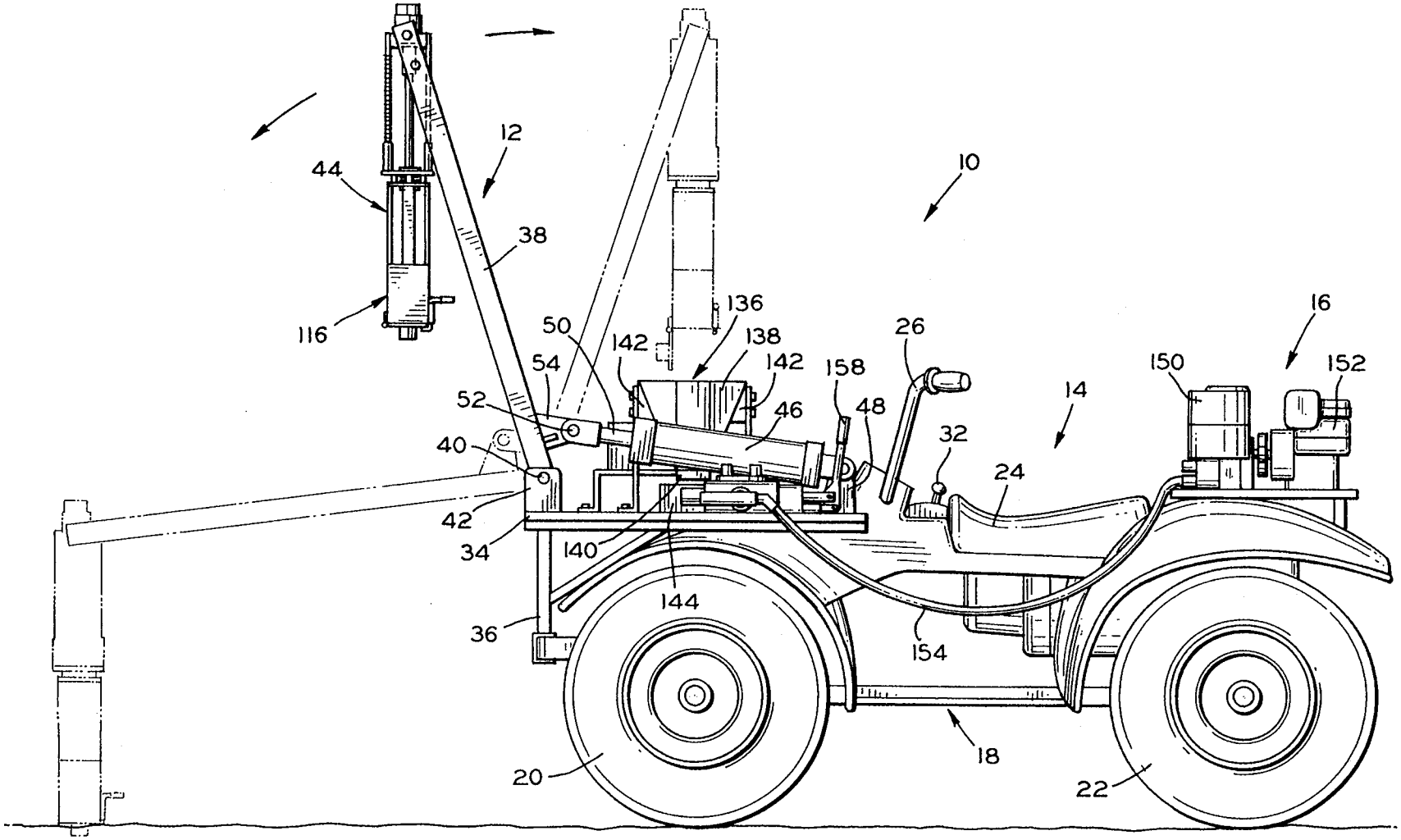
FIG. 1 is a side elevational view of a soil sampling device in accordance with the invention, mounted upon an all terrain vehicle or ATV.

Referring now to the drawings, and particularly to FIG. 1, there is shown generally at 10 a mobile soil sampling unit embodying the invention. More particularly, the mobile unit comprises a soil sampling unit 12 operably mounted as upon a conventional four wheel all-terrain vehicle or ATV, identified generally at 14. A power unit 16 is provided on the vehicle for operating the sampling unit 12.

An ATV-type vehicle is ideally suited as the mobile platform for the sampling unit due to its maneuverability, light weight, relatively low cost and ability to operate under difficult field conditions. However, it is fully contemplated that the sampling unit may as well be adapted for mounting upon and use with other and different mobile units such as a pickup truck or tractor, or it may be mounted upon a trailer to be towed behind other vehicles.

The all terrain vehicle 14 may be of a conventional type widely commercially available and the details of which do not form part of the invention. Such vehicles include a chassis shown generally at 18 mounted upon pairs of forward and rear wheels 20 and 22, respectively, which are adapted for carrying the vehicle over terrain under a wide variety of adverse field conditions. The rear wheels 22 are driven by a suitable power unit (not shown) and the forward wheels 20 are mounted so as to enable an operator (not shown) riding on a seat 24 to steer the vehicle as by handle bars 26. Clutch and brake pedals 28 and 30 and a gear shift lever 32 are conventionally provided for operating the vehicle.

The soil sampling unit 12 is mounted on the chassis 18 at the forward end of the vehicle 14 so as to be readily operable and clearly visible by an operator from the seat 24. The operator is thus able to maneuver the vehicle into position for collecting a soil sample, and to then collect the sample and deposit it in a collection receptacle while remaining seated. To that end the sampling unit 12 comprises a base plate 34 for mounting as upon a framework 36 carried by the chassis 18 of the vehicle 14. A sampling arm 38 is attached at one end by means of a pivot pin 40 to a mounting bracket 42 affixed to the base plate, for pivotal swinging movement in a vertical plane. At its remote end the sampling arm carries a soil boring and collecting unit, identified generally at 44.

The arm 38 is adapted to be swung between the lowered, soil-collecting and the raised, soil-discharge positions as illustrated in broken lines and as indicated by the arrows in FIG. 1. By way of example, the sampling arm may be adapted to swing through an arc on the order of 105°. To that end a suitably controlled linear actuator such as a conventional double acting hydraulic cylinder 46 is coupled to the sampling arm. The cylinder is pivotably connected at one end to a bracket 48 affixed to the base plate 34, and includes an extensible piston rod conventionally coupled by a pivot pin 52 to a bracket 54 affixed to the arm 38. Thus, by suitably manipulating the cylinder 46 as will be described, the piston rod can be extended and retracted to swing the arm 38 through an arc on the order of 105° between the lowered and raised positions as shown in broken lines in FIG. 1. Of course, while the linear actuator in its preferred form has been described as a hydraulic cylinder, it is fully contemplated that other and different devices such as, for example, an air cylinder or a motorized screw drive may be employed.

As best seen in FIGS. 2 through 6, the boring and collecting unit 44 is pivotally carried for free swinging movement at the remote end of the sampling arm 38 so as to assume a vertical orientation regardless of the angular attitude of the arm. To that end, as will be seen in FIG. 6 a tubular sleeve 56 extending laterally from the sampling arm axially receives a bushing 58 within which a post 60 is journalled for rotation. The post is retained within the bushing as by a snap ring 62, and the bushing is retained within the sleeve by means of a set-screw 64 threaded through the sleeve and extending into an annular recess 66 within the bushing. The post, in turn, extends from a collar 68 affixed to a carrier plate 70. The boring and collecting unit 44 depends from a channel section 72 affixed to the carrier plate. It is contemplated that for purposes of cluster sampling, that is, collecting several samples within a small area at once, a plurality of the boring and collecting units may be mounted upon the sampling arm.

The boring and collecting unit is designed so that as the sampling arm 38 is lowered the base of the unit will engage and be urged into contact with the surface of the soil, and the auger will then be urged into the soil to a limited, predetermined depth. Accordingly, slide rods 74 depend downwardly from the opposite flanges 76 of the channel section 72, and extend slidably through openings 78 in wing extensions 80 of a base plate 82. Nuts 84 threaded on the ends of the slide rods beneath the base plate retain the base plate on the rods. Compression springs 86 surrounding the slide rods 74 cooperate with depth sleeves 88 on the slide rods for limiting the depth to which the auger will penetrate the soil as will be described. The depth sleeves can be readily removed and replaced with sleeves of selected lengths for permitting penetration to desired depths by the auger.

A rotary power unit 90 is mounted on the channel section 72 with its output shaft 92 projecting downwardly through the web 94 of the channel section. In a preferred form as illustrated, the power unit may be a conventional hydraulic motor. However, other and different units such as, for example, air motors and electric motors may be employed as well. A drive shaft 96 of hexagonal or other irregular cross section is telescopically received within a mating recess (not shown) in the end of the output shaft 92 and secured therein as by a pin 98. The drive shaft is journalled within and is axially slidable through a bearing unit 100 mounted in a central opening in the base plate 82.

For purposes of further stabilizing the drive shaft 96 as it rotates, a second bearing unit 102 is mounted in a bearing plate 104 affixed in spaced relation beneath the base plate 82 as by bolts 106 and spacers 108. The drive shaft is journalled within and axially slidable through the second bearing unit 102. The upper end of a soil auger 110 of suitable conventional design is telescopically received within an axially extending opening (not shown) at the lower end of the drive shaft and secured therein by a suitable pin or bolt 112. The auger may, of course, be of different types as called for by varying soil and operating conditions.

Oppositely disposed pairs of side bars 114, secured at their upper ends by the bolts 106 to the bearing plate 104, depend downwardly and are affixed at their lower ends to a soil accumulator container 116 defined by side walls 118 and a trap door or floor 120. In order to permit dumping of collected soil the floor is connected to the wall 118 along its rear edge, that is, the edge opposite the operator's station, by a hinge 122. A latch mechanism is provided along the edge of the receptacle 116 opposite the hinge for selectively latching the trap door in a closed position and allowing it to pivot downwardly for discharging collected soil.

Figure 3:
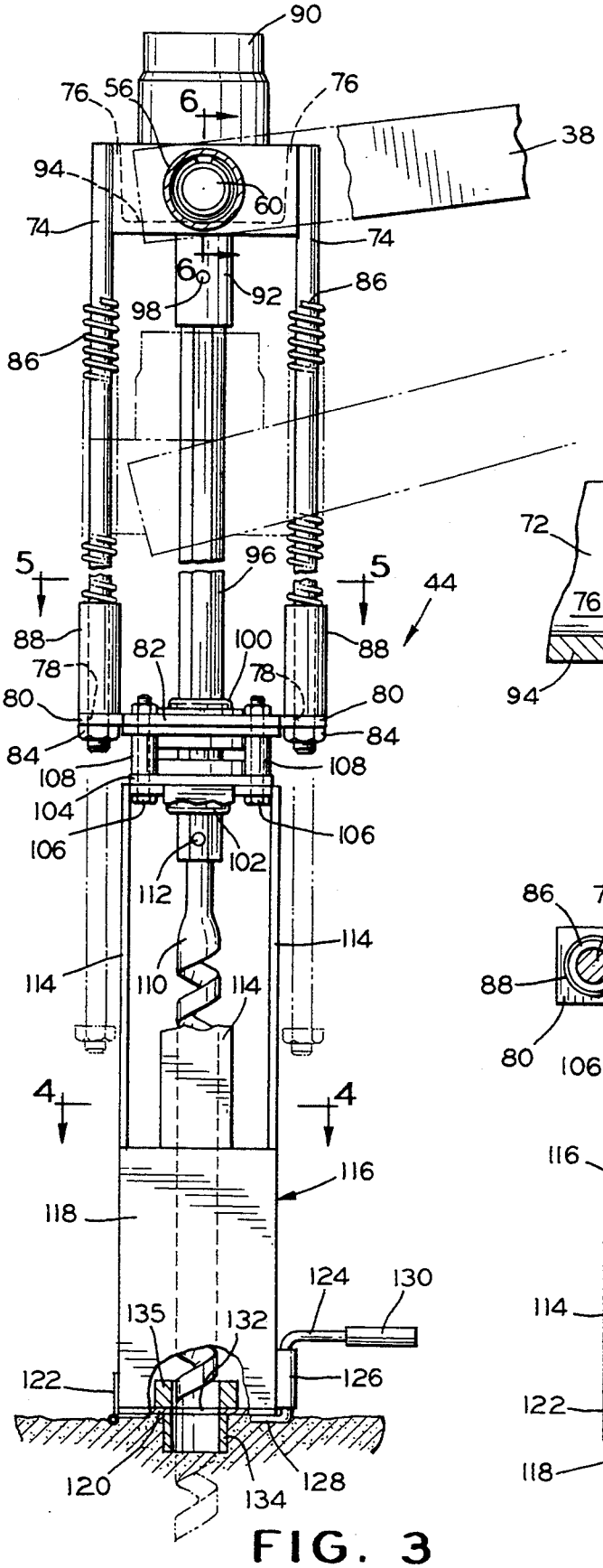
FIG. 3 is an enlarged fragmentary side elevational view of the drilling unit of the invention, with parts broken away.
Figure 6:
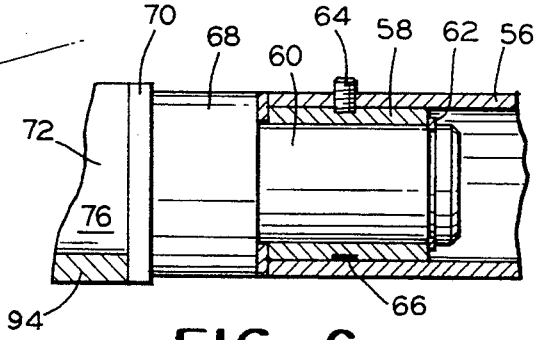
FIG. 6 is a sectional view taken substantially along line 6—6 of FIG. 3.
Figure 5:
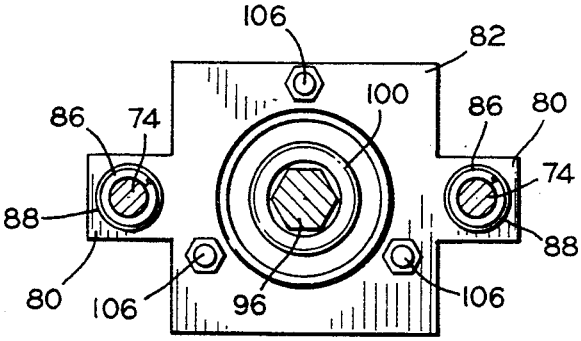
FIG. 5 is a sectional view taken substantially along line 5–5 of FIG. 3.
Figure 4:
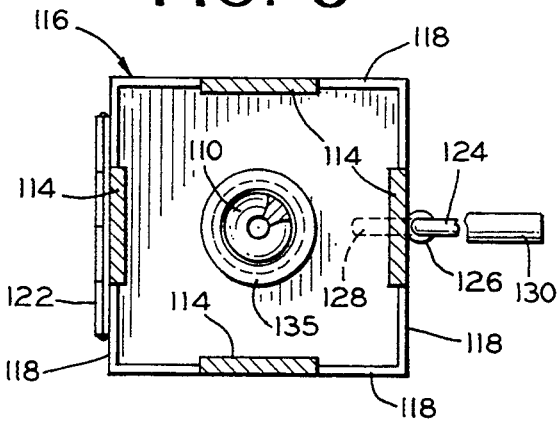
FIG. 4 is a sectional view taken substantially along line 4—4 of FIG. 3.

The latch mechanism is adapted to be readily manipulated by the operator from the seat with the sampling arm in the retracted position as shown in FIG. 1, and may obviously comprise any of various devices commonly employed for similar purposes such as a spring clip or a spring loaded latch. In the illustrated embodiment a latch member 124 is pivotably carried within a sleeve 126 affixed to the side wall 118 of the receptacle. The latch member includes a finger 128 for engaging beneath the trap door 120 in its closed position and a handle extension 130 by which the latch member can be manually pivoted between the door retaining closed position as shown in FIGS. 3 and 4, and the door released position illustrated in broken lines in FIG. 1.

In order to accommodate the soil auger 110 as it is extended from the receptacle 116 for gathering a soil sample, the trap door 120 is provided with a central opening 132 having a slightly greater diameter than that of the auger. The rotating auger may tend to displace soil laterally at the soil surface-trap door interface as it bores into the soil, particularly if the soil surface is uneven so that the trap door does not seat firmly against the surface. To obviate this condition an annular collar 134 is affixed within the aperture 132 or to the underside of the trap door surrounding the aperture. As the boring and collecting unit 44 is lowered by the arm 38, the collar is depressed into the soil to avoid any gap between the soil surface and the trap door, and thereby to prevent lateral displacement of soil by the auger.

The rotating auger will, of course, tend to deflect laterally as its free end advances into the soil, and in so doing will engage the collar 134 or the wall surrounding the aperture 132 in the trap door. In order to reduce wear on the auger and prolong the life of the trap door and the annular collar, the collar may be fabricated of a hard wood or other suitable wear-resistant material. Also, a bushing 135 of similar material may be suitably mounted on the top surface of the trap door surrounding the central aperture 132.

Figure 2:
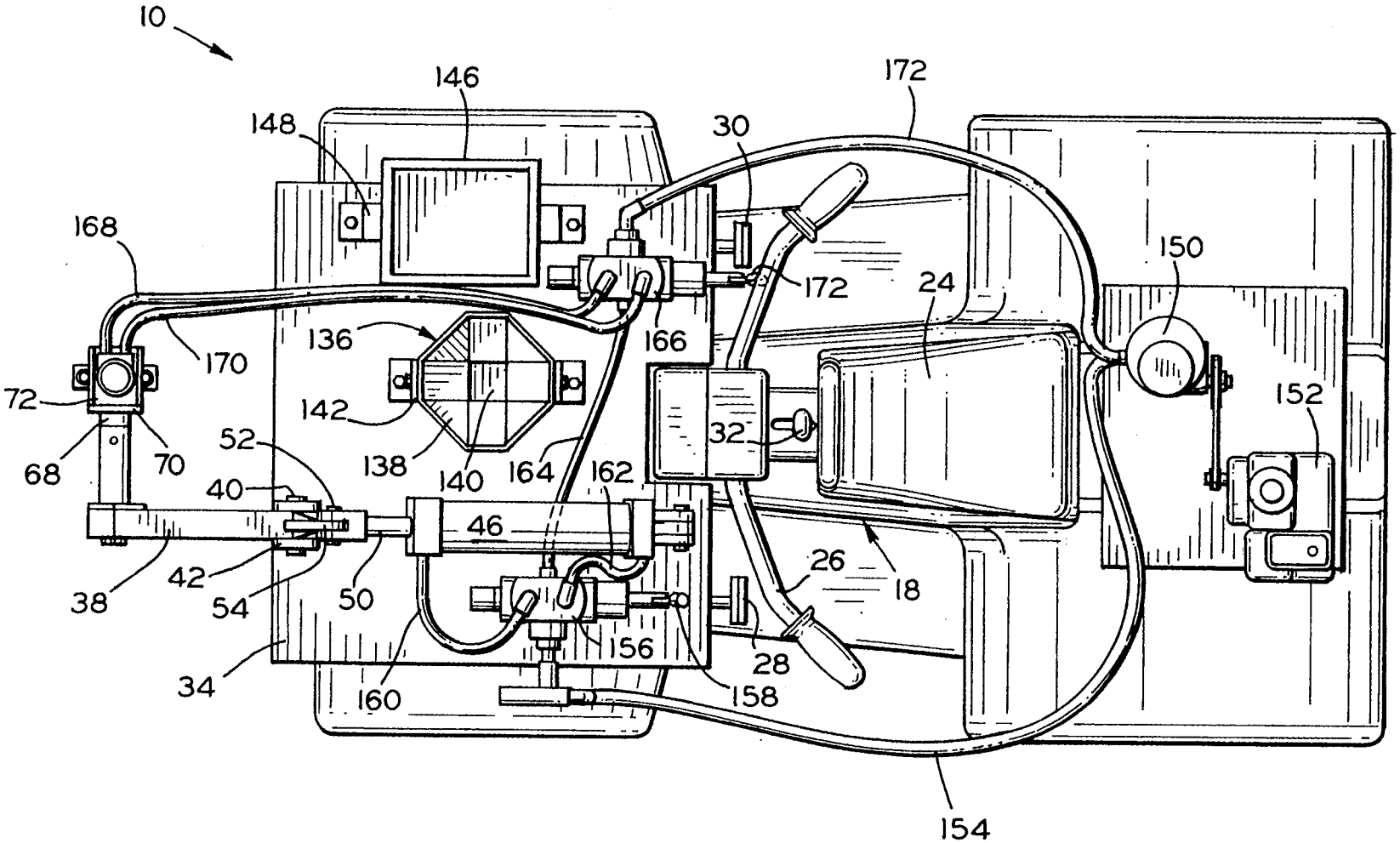
FIG. 2 is a top plan view of the device of FIG. 1.

As best seen in FIGS. 1 and 2, for purposes of depositing collected soil samples in individual containers there is mounted on the base plate 34 in the path of the receptacle 116 as the sampling arm is retracted, a funnel-shaped collecting hopper 136. The hopper comprises side walls 138 converging downwardly to a central spout outlet 140. The hopper is mounted on the base 34 plate by means of leg assemblies 142 whereby the outlet from the spout is sufficiently elevated to permit insertion of an open topped container 144 therebeneath. The spout outlet may also be provided with means for holding plastic or other types of bags for receiving the collected soil samples. A box 146 is mounted on a holder 148 affixed to the base plate 34 for storing a supply of the empty containers 144 and for receiving and storing filled containers. Both the funnel shaped hopper 136 and the box 146 are positioned so as to be readily accessible to the operator from the seat 24. The trap door 120 can likewise be operated with the receptacle 116 in the discharge position over the hopper.

As heretofore indicated the cylinder 46 for operating the sampling arm 38 and the rotary power unit 90 may advantageously be hydraulically driven. To that end, the power unit 16 includes a hydraulic pump and reservoir unit 150 driven by a gasoline engine 152. The hydraulic pump provides fluid under pressure through a conduit 154 to a two way control unit 156 mounted along side the cylinder 46. The control unit is manually operable by a lever 158 to selectively supply fluid under pressure to and return fluid from the double acting cylinder 46 on opposite sides of a piston (not shown) connected to the piston rod 50 through conduits 160 and 162. Thus by manipulation of the lever 158, the piston rod can be selectively extended and retracted to move the sampling arm 38 through its range of motion as illustrated in FIG. 1.

In order to operate the rotary power unit 90 of the boring and collecting unit 44, a conduit 164 delivers hydraulic fluid under pressure from the control unit 156 to a second two way control unit 166 conveniently mounted on the base plate 34. Conduits 168 and 170 connect the control unit to the rotary power unit 90 and provide a flow path for hydraulic fluid from the control unit through the power unit and back to the control unit. A control lever 172 on the control unit is manually operable by the operator for directing hydraulic fluid through the conduits 168 and 170 to selectively rotate the power unit 90, and thus the auger 110, in either direction. A hydraulic fluid return conduit 172 connects the control unit 166 with the pump and reservoir unit 150. As will be readily appreciated, separate hydraulic fluid supply and return conduits (not shown) may alternatively be provided between the pump and reservoir unit 150 and each of the two way control units 156 and 166 in place of interconnecting the control units by means of the conduit 164.

Reviewing briefly operation of the invention, in preparation for collecting soil samples the depth to which sampling is desired is determined, and depth sleeves 88 of appropriate length are installed on the slide rods 74 below the compression springs 86. A supply of the sample boxes or containers 144, appropriately marked with field locations, is stored in the box 146 on the vehicle. The operator drives the ATV to a selected sampling location and, upon reaching the location, engages the rotary power unit 90 by means of the control lever 172 to rotate the soil auger 110 in the appropriate direction. Various procedures may be employed in selecting sampling locations. For example, it is contemplated that a global positioning system (not shown) may conventionally be employed for directing the vehicle to predetermined sampling locations.

With the hinged trap door 120 closed and latched, the piston rod 50 is extended by manipulating the lever 158 to swing the sampling arm 38 downwardly and lower the boring and soil collecting unit 44 until the bottom or trap door engages the soil surface. As the arm is further lowered, the springs 86 are compressed to embed the annular collar into the soil and urge the trap door firmly against the soil surface. As the arm 38 is further lowered the springs continue to compress and the drive shaft 96 pushes the spinning auger into the soil. When the springs are fully compressed between the depth spacers 88 and the channel section 72, further penetration is prevented. The soil augerings are, of course, brought up into the receptacle 116 by the auger flighting.

With the auger preferably still spinning the arm 38 is raised by manipulating the lever 158 to retract the piston rod 50. If a composite sample is to be collected, that is, if multiple borings are to be combined for a single sample, the arm need only be raised enough for the bottom of the unit 44 to clear any terrain and debris. The operator then moves the ATV to the next sampling location. The procedure is repeated for each individual sample collected in the composite.

When sample collection is completed the piston rod 50 is retracted to retract the arm 38 over center to the position shown in broken lines in FIG. 1, with the receptacle 116 directly over the funnel-shaped hopper 136. With the receptacle thus positioned over the hopper, rotation of the auger is discontinued. The operator then releases the latch member 124 to open the trap door 120. The collected soil drops into the hopper and subsequently into the container 144. Any soil which may tend to cling to the auger or receptacle 116 can be easily manually dislodged to drop into the container. Also, the auger may be rotated in the opposite direction to assist in dislodging soil. The container 144 is then removed from beneath the hopper and closed, and placed in the storage box 146. The trap door is closed and latched by the operator and the sampling unit is ready to repeat the soil sample collecting procedure.

It is to be understood that the forms of the invention herewith shown and described are to be taken as illustrative preferred embodiments only of the same, and that various changes in the shape, size and arrangement of parts may be resorted to without departing from the spirit of the invention.

What is claimed is:

1. A mechanized soil sampling device comprising, in combination, a base frame adapted to be mounted upon a vehicle, an elongated sampling arm pivotably mounted upon said base frame, a soil boring and collecting unit pivotably carried by said sampling arm, said soil boring and collecting unit including a receptacle and an auger adapted to be selectively advanced through the receptacle bottom and into the soil for drawing soil upwardly into said receptacle, means for rotatably driving said auger, funnel means mounted on said base frame for receiving collected soil from said receptacle and depositing said soil into a container therebeneath, and actuating means connected to said sampling arm for controllably pivoting said sampling arm between a lowered position at which soil is collected in said receptacle and a raised position at which said receptacle is positioned over said funnel means, said receptacle including door means openable to deposit soil from said receptacle into said funnel means with said receptacle positioned over said funnel means.

2. A mechanized soil sampling device as claimed in claim 1, wherein said actuating means comprises a linearly extendible and retractable actuator operably connected between said base frame and said sampling arm.

3. A mechanized soil sampling device as claimed in claim 2, wherein said actuator comprises a hydraulic cylinder with a piston rod, including cylinder control means for selectively axially extending and retracting said piston rod.

4. A mechanized soil sampling device as claimed in claim 1, wherein said soil boring and collecting unit comprises an upper support member carried by said support arm, means mounting a base plate beneath said upper support member for movement toward and away from said upper support member, means mounting said receptacle beneath said base plate, a drive shaft extending from said means for rotatably driving said auger through said base plate for connection to said auger, said drive shaft being rotatably journalled in and axially slidable through said base plate whereby as said arm is lowered after said receptacle bottom engages the soil surface said base plate is urged toward said upper support member and said drive shaft advances axially through said base plate and said auger is advanced into the soil.

5. A mechanized soil sampling device as claimed in claim 4, wherein said means mounting said base plate includes at least one slide rod affixed to one of said upper support member and said base plate and slidably extending through the other, and a compression spring surrounding said slide rod between said upper support member and said base plate for urging said upper support member and said base plate apart.

6. A mechanized soil sampling device as claimed in claim 5, including a pair of said slide rods affixed to said upper support member at opposed locations, and an interchangeable depth sleeve on each said slide rod cooperable with said compressing spring for limiting the distance by which said auger will advance beneath said receptacle bottom and into the soil.

7. A mechanized soil sampling device as claimed in claim 1, wherein said means for rotatably driving said auger comprises motor means mounted upon said soil bearing and collecting unit, and a drive shaft connecting said motor means to said auger.

8. A mechanized soil sampling device as claimed in claim 7, wherein said means for rotatably driving said auger comprises a hydraulic motor.

9. A mechanized soil sampling device as claimed in claim 1, including an all terrain vehicle upon which said base frame is mounted, said all terrain vehicle including a power source for operating said actuating means and said means for driving said auger.

10. A mechanized soil sampling device as claimed in claim 9, wherein actuating means connected to said sampling arm comprises a hydraulic cylinder and said means for rotatably driving said auger comprises a hydraulic motor, including a hydraulic pump mounted on said vehicle, means for driving said hydraulic pump, and conduit means operably coupling said hydraulic pump to said hydraulic cylinder and said hydraulic motor.

11. A mechanized soil sampling device as claimed in claim 10, including seat means on said vehicle for accommodating an operator, and hydraulic control means operable from said seat whereby said operator selectively controls operation of said hydraulic cylinder and said hydraulic motor.

* * * * *